United States Patent [19]

Amann

[11] Patent Number: 5,018,477

[45] Date of Patent: May 28, 1991

[54] SKI WAXING MACHINE

[76] Inventor: Peter M. Amann, Magnusstr. 25, 8960 Kempton, Fed. Rep. of Germany

[21] Appl. No.: 441,825

[22] Filed: Nov. 27, 1989

[30] Foreign Application Priority Data

Dec. 21, 1988 [EP] European Pat. Off. ..... 88121366

[51] Int. Cl.[5] ..... B05C 1/02; A63C 11/08

[52] U.S. Cl. ..... 118/242; 118/72; 118/244; 118/500

[58] Field of Search ..... 118/72, 238, 242, 244, 118/256, 258, 262, 500, 501

[56] References Cited

U.S. PATENT DOCUMENTS

| | | | |
|---|---|---|---|
| 2,537,511 | 1/1951 | Coulombe | 118/72 |
| 3,045,639 | 7/1962 | Kurlander et al. | 118/72 |
| 3,136,659 | 6/1964 | Walker et al. | 118/72 |
| 3,425,394 | 2/1969 | Rey | 118/72 |
| 4,457,255 | 7/1984 | Amann | 118/72 |
| 4,577,586 | 3/1986 | Morris et al. | 118/72 |
| 4,905,625 | 3/1990 | Funke | 118/58 |

FOREIGN PATENT DOCUMENTS

| | | | |
|---|---|---|---|
| 548510 | 9/1956 | Italy | 118/72 |

*Primary Examiner*—James C. Housel
*Attorney, Agent, or Firm*—Notaro & Michalos

[57] ABSTRACT

A ski waxing machine (10) includes a housing (12), a pair of parallel oblong recesses, each one to receive one ski are provided in a deck wall of the housing (12). Two rows of supporting elements (18) are provided to completely close the recesses from below and to support the skis. Each row includes a multiplicity of supporting elements which individually can be displaced laterally into a rest position to open an area of the recess respectively. A longitudinally reciprocating slide includes a waxing device for applying wax to the running surfaces of the skis and tracks to individually retract the supporting elements from their supporting positions upon approach of the slide and to return the supporting elements when the slide has passed.

15 Claims, 6 Drawing Sheets

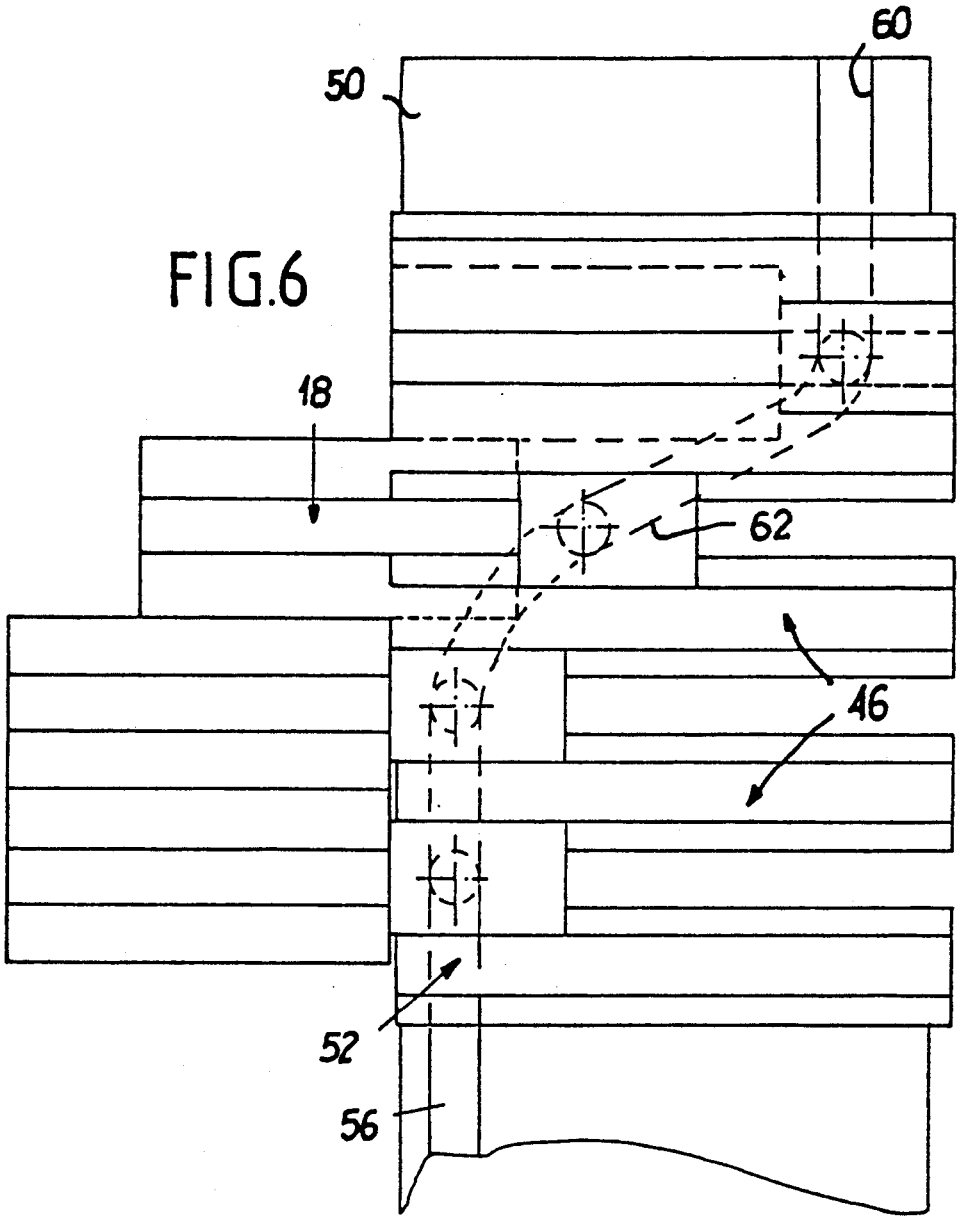
FIG.6
FIG.7
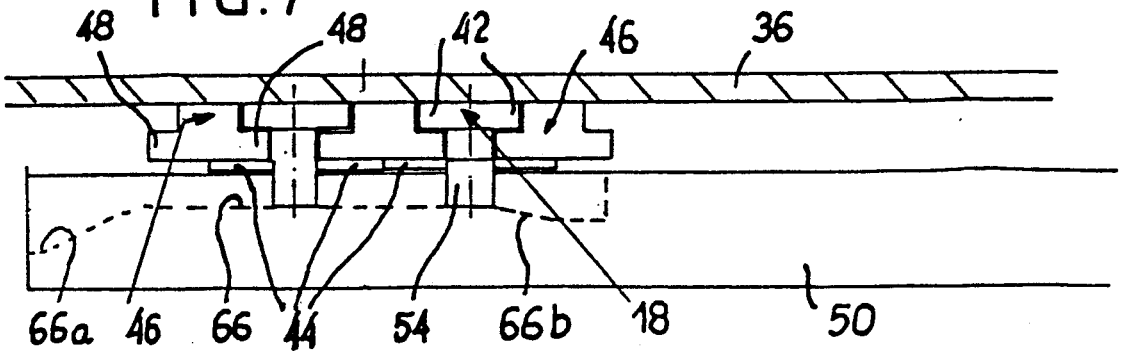

SKI WAXING MACHINE

BACKGROUND OF THE INVENTION

The invention relates to a ski waxing machine comprising an oblong housing provided with at least one oblong deck recess, a plurality of supporting elements arranged below said recess within said housing supporting at least one ski, a slide guided along rails in longitudinal direction of the housing, a driving motor and a driving arrangement arranged within the housing for a reciprocating motion of the slide, waxing means provided at the slide for applying a coating of wax onto the running surfaces of the skis, said plurality of supporting elements arranged in the moving path of the slide extending substantially crosswise to the longitudinal direction of the housing and being movably arranged between a supporting position respectively inside of the moving path of the slide and a rest position outside thereof, driving means provided at the slide for moving the plurality of supporting elements one after another into their rest positions upon approach of the waxing means respectively, and reset means for returning the plurality of supporting elements into their supporting positions after having been passed by the waxing means respectively.

A ski waxing machine of this kind is known from my U.S Pat. No. 4,457,255. The supporting elements form two rows of six pivotably mounted swinging flaps respectively. Both rows of swinging flaps extend from opposite sides to a vertical center plane of the housing into the area below the recess to support both skis while being worn by the user. While this known waxing machine provides a plurality of advantages over another proposal published in the U.S. Pat. No. 3,045,639, it can be improved further in order to avoid that snow and ice can fall through the recess into the housing when the machine is not in use and to reduce cost of production especially with respect to the method of bearing and operation of the supporting elements.

SUMMARY OF THE INVENTION

Therefore, it is one object of the invention to provide a waxing machine which avoids the aforementioned disadvantages.

One further object of the invention is to provide a waxing machine, the deck recess thereof being completely closed when not in use.

A still further object of the invention is to provide a waxing machine in which the plurality of supporting elements form a cover to close the deck recess from below when the machine is not in use.

Another object of this invention is to provide a waxing machine, the bottom cover of the recess opened only at those areas at a time during operation thereof where treating means project therethrough and contact the running surfaces of the skis.

Still another object of the invention is to provide a waxing machine, in which the supporting elements are forcibly actuated to move into their rest positions and to return them into their supporting positions without requiring separate return operating means as springs.

One further object of the invention is to provide a waxing machine, in which a multiplicity of identical supporting elements are arranged at least in form of one row, one supporting element at least substantially contacting adjacent ones to form a continuous cover below the deck recess.

Last but not least, it is an object of the invention to provide a waxing machine, in which the supporting elements form slide pieces which can simply be displaced linearly substantially at right angles to a vertical longitudinal center plane from their supporting positions into rest positions and vice versa by means of transfer tracks fastened at a running slide engaging with followers provided at the supporting elements respectively.

Further objects and features of the present invention will become apparent from the following specification and claims taken together with the accompanying drawings.

BRIEF DESCRIPTION OF THE DRAWINGS

The drawings show a prefered embodiment of the invention, in which

FIG. 6 is a plan view of the arrangement of supporting elements in greater detail showing the displacements thereof from the beginning until the rest positions have been reached;

FIG. 7 is a longitudinal section of a plurality of supporting elements mounted in a guide arrangement for a sliding movement.

DESCRIPTION OF A PREFERRED EMBODIMENT

Figure 3:
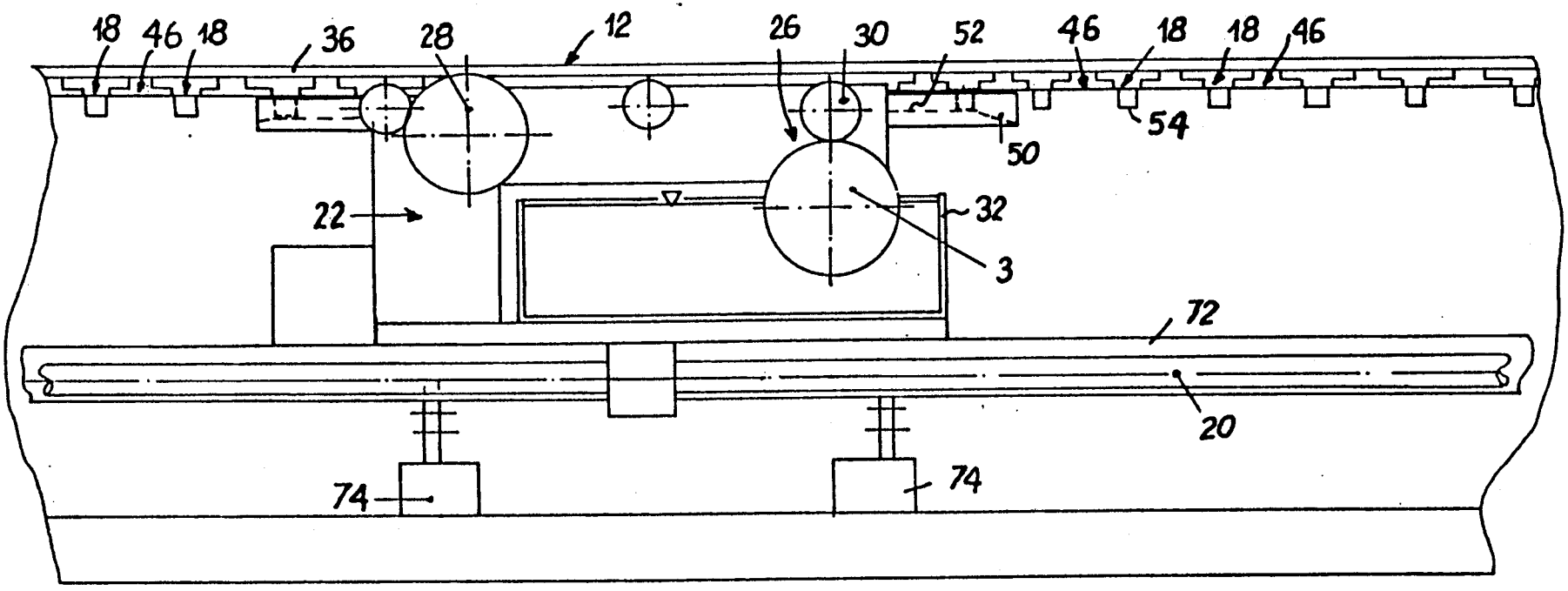
FIG. 3 is a side view of a portion of the waxing machine showing a slide, a cleaning and coating device and supporting elements.

A waxing machine 10 for cleaning and waxing running surfaces of a pair of skis comprises a housing 12 which is formed mirror-invertedly with respect to a vertical longitudinal center plane 14. An oblong recess 16 for one ski is provided in each longitudinal half of the housing 12. Both recesses 16 are closed from below by a pair of rows of supporting elements 18 respectively on which the pair of skis are supported. The housing 12 projects from the ends of the recesses 16 by a head portion and a foot portion in which the ends of a spindle 20 (FIG. 3) are mounted for rotation. The spindle 20 is in thread engagement with a slide 22 guided at longitudinally extending rails for reciprocating the slide 22. A driving gear 24 operatively connects the spindle 20 with an electric motor. The machine 10 in only by substantially half of the ski length longer than the skis.

Figure 1:
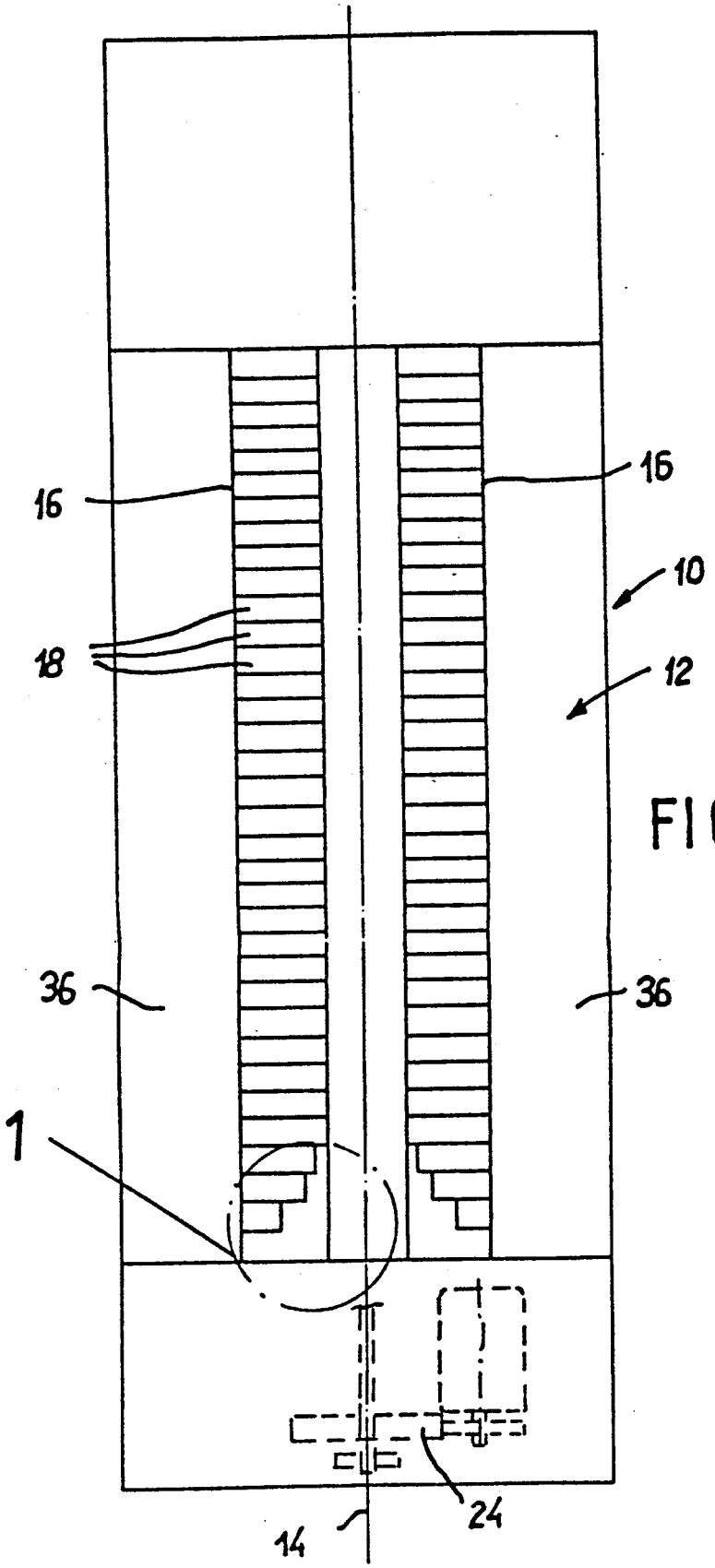
FIG. 1 is a plan view of a waxing machine at the beginning of operation with the skis omitted.

The user enters the machine 10 with his skis which rest on the supporting elements 18 within the recesses 16 which are still completely closed. By inserting a coin into a slot paying mechanism the motor starts and the slide 22 begins to move longitudinally (in FIG. 1 upwards). All supporting elements 18 ahead of the slide 22 are displaced outwardly in pairs one pair after another one in opposite directions by means of a pair of tracks 52 arranged at the slide 22, whereby the recesses 16 successively become opened and and a treating device 26 comprising at least a cleansing roller 28 and a waxing roller 30 can engage with the running surfaces of the skis. The waxing roller 30 is in contact with a wax receiving roller 34 immerging into a wax container 32. The supporting elements 18 are displaced in outward directions from a supporting and recess closing position respectively into a rest position under deck walls 36 of the housing 12 adjoining the recesses 16 in outward direction to open the recesses. The supporting elements 18 remain there until the slide 22 has passed and thereafter by the trailing end of the slide are returned into their supporting positions. Therefore, the skis are permanently supported by at least 80 percent of the total number of supporting elements, whereby each single supporting element 18 is stressed only by a small extent and the two rows of for example fifty supporting elements respectively provide for a safe stand of the skis.

Figure 2:
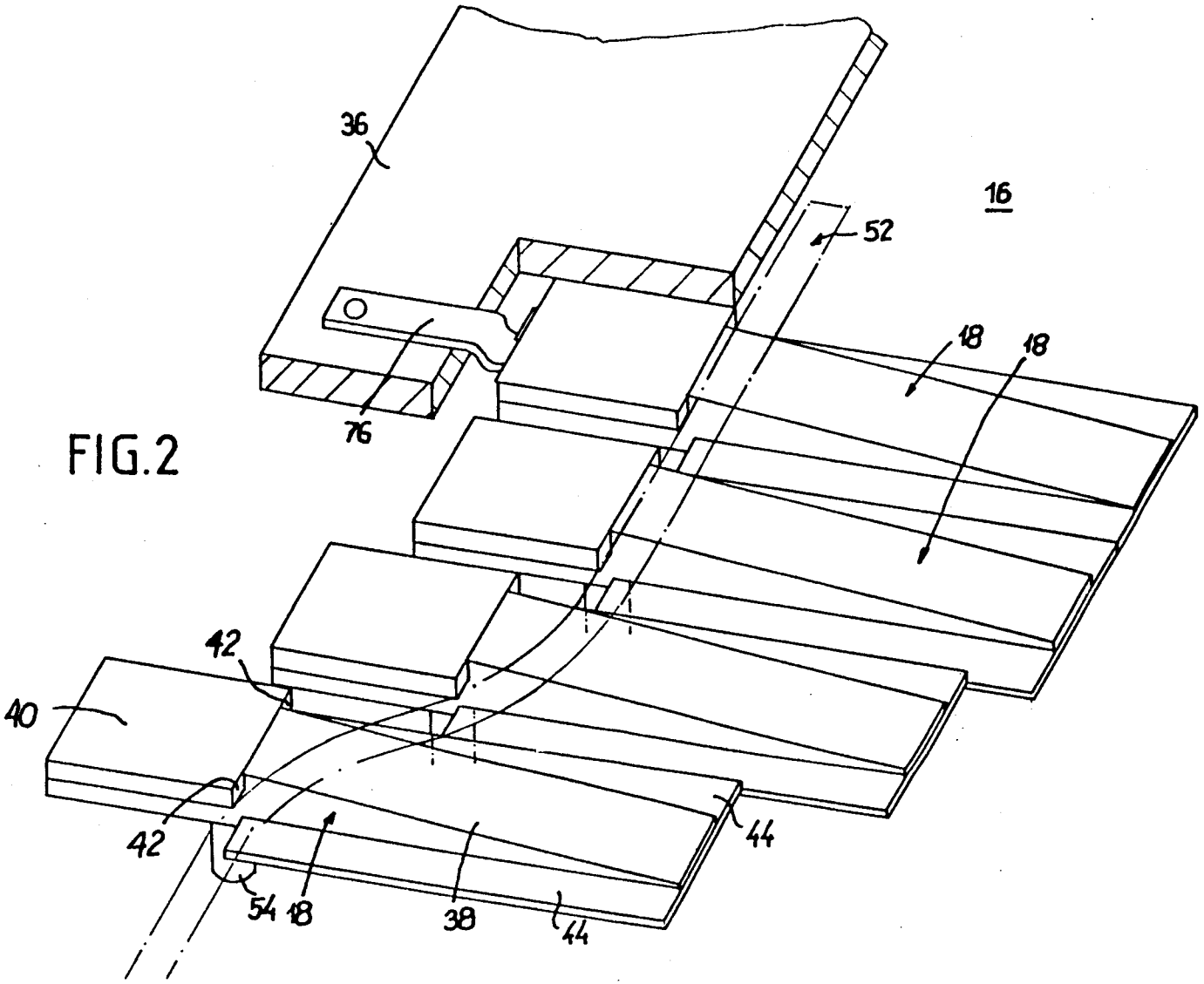
FIG. 2 is a perspective view of displaced supporting elements provided in the portion marked "1" in FIG. 1.

The form of each supporting element 18 is best shown in FIG. 2. Each supporting element 18 consists of a supporting portion 38 having a length equal with the width of the recess 16 and a guiding portion 40. The upper surface of the supporting portion 38 forms a slight angle with that of the guiding portion 40. The angle is in the region of 20 degrees. The guiding portion 40 has a pair of lateral flanges 42, the upper surfaces thereof being flush with that of the central body therebetween. The supporting portion 38 is formed with lateral wings 44 which project laterally at the bottom side thereof and extend over the whole width of a recess 16. The width of the wings 44 is larger than that of the flanges 42 and each wing 44 contacts adjacent ones. Therefore, the flanges 42 of adjacent supporting elements 18 are spaced from one another and a central body of a guiding rail 46 extend therebetween for guiding the supporting elements 18. At both sides of the central body of the guiding rail 48 supporting ribs 48 are provided respectively which are flush with the bottom side of that central portion. The space between adjacent supporting ribs 48 of adjacent guiding rails 46 is substantially equal with the width of the central body of a supporting element 18 therebetween. Therefore, a pair of guiding rails 46 together with the deck wall 36 of the housing form a T-groove in which the T-shaped guiding portion 40 of the supporting elements 18 is received. Thereby the supporting ribs 48 of the guiding rails 46 grip under the flanges 42 of supporting elements 18 and form supporting means therefore, as seen in FIG. 7. As described above, the wings 44 contact one another, however, a clearance for a relative displacement therebetween is provided. The wings 44 are on a level that they can pass below the guiding rails 46 when the supporting elements 18 become displaced.

Figure 4:
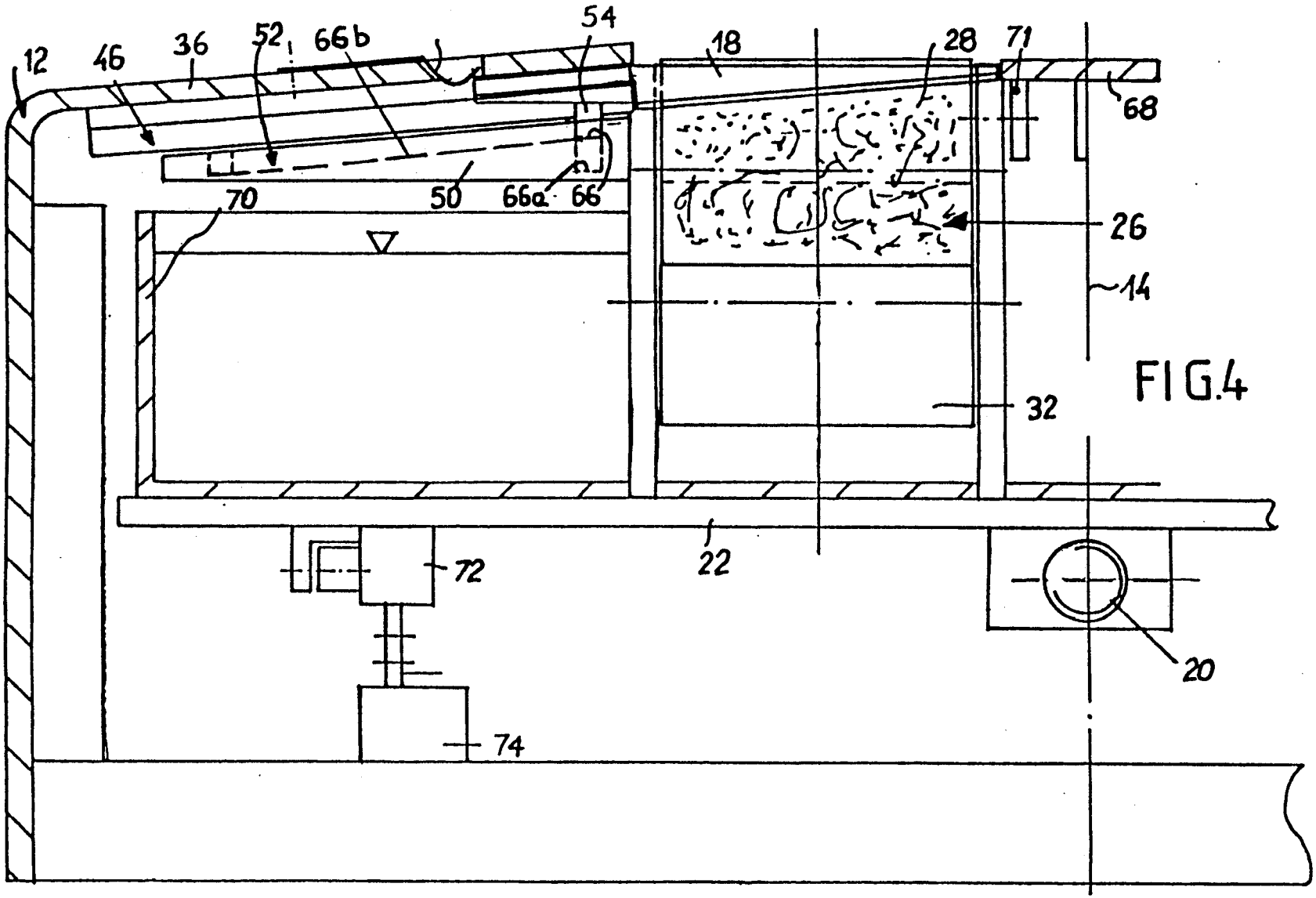
FIG. 4 is a corss-section of the left half of the waxing machine.

As seen in FIG. 4, the deck walls 36 of the housing 12 form an angle of about 20 degrees with a horizontal plane respectively and are inclined upwardly to the longitudinal vertical center plane 14. This angle is the same as that between the upper surfaces of the supporting portion 38 and the guiding portion 40 of the supporting elements 18 respectively. Therefore, opposite ends of the upper surface of the supporting portion 38 are contacted by a horizontal tangential plane. The upper surface of the supporting portion 38 is concavely curved—as seen in cross-section. Therefore only the steel edges of the skis are in contact with the supporting elements 18. During displacement of the supporting elements 18 leftwards—as seen in FIG. 4—from their supporting positions into their rest positions, the supporting elements 18 simultaneously are lowered and come out of engagement with the skis.

Figure 5:
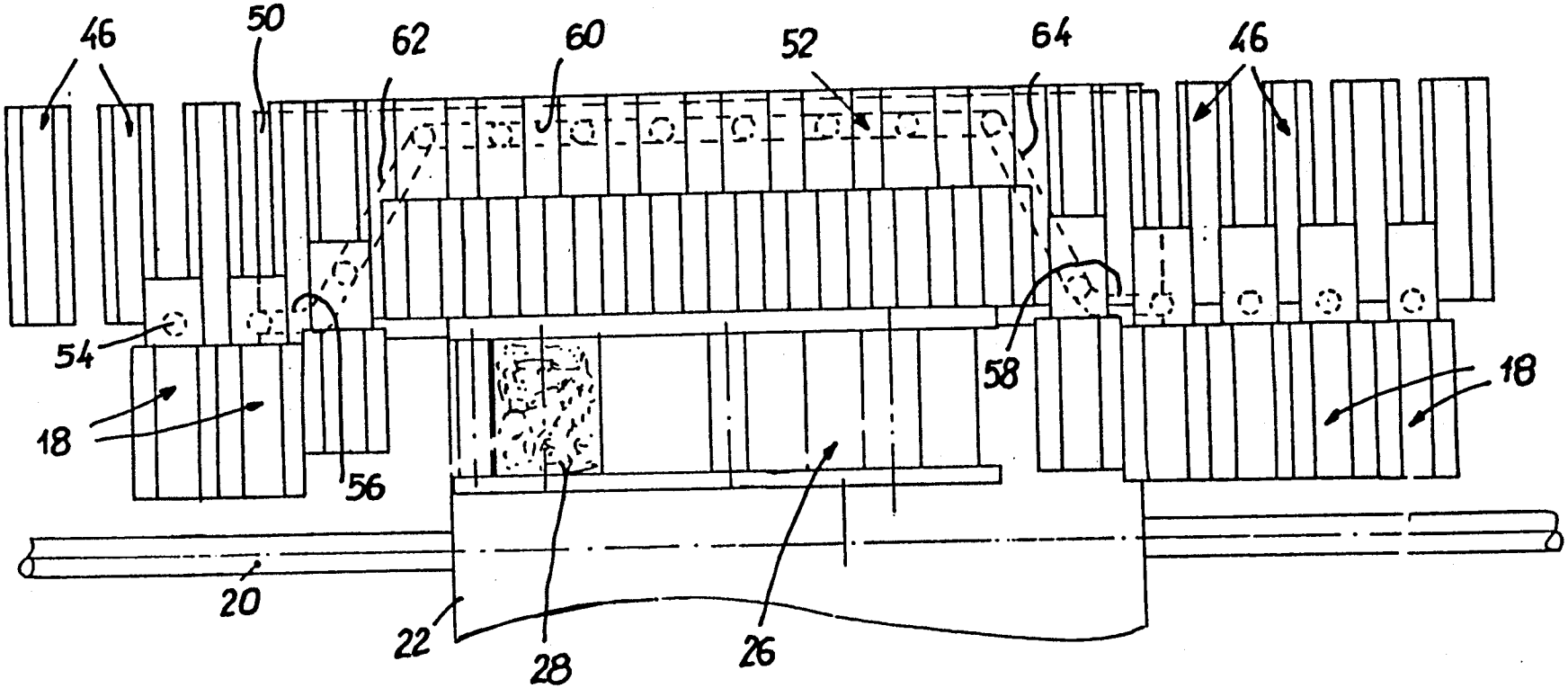
FIG. 5 is a schematic plan view of an arrangement of supporting elements of the waxing machine, wherein some supporting elements have been moved into their rest positions.

For each one of the rows of supporting elements 18 a laterally projecting plate 50 is fastened at the slide 22, and a track 52 is formed in that plate for reciprocating the supporting elements 18. The track 52 consists of an open-ended groove into which a downwardly projecting pin 54, provided at each supporting elements 18 can engage. The shape of the track 52 is best shown in FIG. 5. The track 52 comprises a leading end track portion 56, a first transfer track portion 62 a longitudinally extending holding track portion 60, a second transfer track portion 64 and a trailing end track portion 58. Both end track portions 56, 58 are longitudinally aligned, open in opposite directions and are arranged closely adjacent the inward edge of the deck wall 36. The holding track portion 60 is spaced laterally from a line connecting both end track portions 56, 58 by an amount which is at least equal with the width of the recess 16. Both transfer track portions are straight as the other track portions, form a mirror-inverted arrangement and are angled with respect to the longitudinal and the cross-wise directions. All transitions between adjacent track portions are curved as best seen in FIG. 6. Thus the holding track portion and both transfer track portions together form an equal-angle trapezoid with the longer one of both parallel sides thereof omitted.

In operation, the slide 22—as seen in FIG. 5—is moved leftwards by the rotating spindle 20. Two left-side supporting elements 18 are in their supporting positions. The pin 54 of the right one thereof is entering the leading end track portion 56 of the track 52. When the slide 22 proceeds, pin 54 of this supporting element is engaged by the transfer track portion 62 and the supporting element is retracted outwardly until its rest position is reached when the pin enters the holding track portion 60. The supporting element has completely been moved under the deck wall 36 and the slide 22 together with the rollers 28, 30 can pass, whereafter—when the pin enters the trailing transfer track portion 64—the supporting element 18 is returned into its supporting position.

The track 52 could be a slot. In the embodiment as shown in FIG. 7 a bottom 66 is provided at least in the regions of the end track portions 56, 58 respectively. As shown in FIG. 4 and FIG. 7 the bottom 66 has an upwardly inclined inlet portion 66*a* at the beginning of the leading end track portion 56 and a downwardly sloping outlet portion 66*b* at the transition between the latter and the first transfer track portion. The same bottom configuration is provided at the trailing end track portion 58. The bottom 66 serves to support the pins 54 of the supporting elements 18 and to lift the supporting elements 18 by a small amount within their vertical clearance. Thereby also the ski is lifted by a samll extent and the adjacent supporting element which is is in position to start its retracting motion is disengaged from the ski.

Between both recesses 16 a central longitudinal deck web 68 is provided. The bottom of the deck web 68 forms a running path for friction rollers 71 mounted for rotation at the slide 22 and drivingly connected with the cleaning and waxing rollers 28 30 respectively.

A wax store tank 70 is provided at each lateral side end of the slide 22 below the deck wall 36 and is in communication with the adjacent one of a pair of wax containers 32 by means of metering devices. Thanks to the provision of the store tanks 70 the wax containers 32 need only have a small longitudinal dimension.

The spindle 20, the driving gear 24 and its motor are supported on a lifting frame 72 at which also the guide rails for slide 22 are fastened. The lifting frame 72 can be lowered by four solenoids 74 in order to return the slide in rapid motion beneath the supporting elements 18 remaining in their supporting positions because the tracks 52 do not engage with the pins 54 of the supporting elements.

In order to avoid that the supporting elements 18 unintentionally leave their supporting positions, one leaf spring 76 (FIG. 2) for each supporting element 18 is fastened at the deck wall 36 and engages with the outward end thereof to hold the supporting element in its supporting position.

I claim:

1. A ski waxing machine comprising an oblong housing provided with at least one oblong deck recess, a plurality of supporting elements arranged below said recess within said housing supporting at least one ski, a slide guided along rails in longitudinal direction of the housing, a driving motor and a driving arrangement arranged within the housing for a reciprocating motion of the slide, waxing means provided at the slide for applying a coating of wax onto the running surfaces of the skis, said plurality of supporting elements arranged in the moving path of the slide, extending substantially crosswise to the longitudinal direction of the housing and being movably arranged between a supporting position respectively inside of the moving path of the slide and a rest position outside thereof, driving means provided at the slide for moving the plurality of supporting elements one after another into their rest positions upon approach of the waxing means respectively, and reset means for returning the plurality of supporting elements into their supporting positions after having been passed by the waxing means respectively wherein the plurality of supporting elements are mounted for a sliding movement substantially in crosswise direction to the longitudinal direction of the housing, and are arranged tightly adjacent one another and in their supporting positions form at least one cover arrangement substantially completely covering the deck recess of the housing from below, wherein further the driving means and the reset means are formed by a pair of transfer tracks respectively provided at leading and trailing areas of the slide respectively, wherein each one of the plurality of supporting elements has a bottom surface at which a follower is arranged to engage with each one of the pair of transfer tracks one after another, the transfer tracks arranged in one and the same plane mirror-invertedly with respect to a vertical cross plane and extending from inward ends to laterally and longitudinally offset outward ends respectively, wherein the inward ends of the pair of transfer tracks are longitudinally aligned and are laterally spaced from the longitudinally aligned outward ends by an amount substantially equal with the displacement of each one of the supporting elements between the supporting position and the rest position thereof.

2. A ski waxing machine as claimed in claim 1, wherein the outward ends of the pair of transfer tracks are connected by a longitudinally extending holding track.

3. A ski waxing machine as claimed in claim 2, wherein a continuous track comprising the pair of transfer tracks and the holding track is formed substantially as an equal-angle trapezoid with the longer one of both parallel sides omitted.

4. A ski waxing machine as claimed in claim 1, wherein longitudinally extending and oppositely directed end tracks are connected with the transfer tracks at the inward ends thereof respectively.

5. A ski waxing machine as climed in claim 1, wherein each one of the pair of transfer tracks is connected with at least one longitudinal track portion by a curved transition track portion.

6. A ski waxing machine as claimed in clim 1, wherein the transfer tracks are formed as open-top grooves.

7. A ski waxing machine as claimed in claim 1, wherein each one of the transfer tracks is formed as a slot provided in a plate fastened at the slide.

8. A ski waxing machine as claimed in claim 1, wherein the follower is formed as a downwardly extending pin.

9. A ski waxing machine as claimed in claim 1, wherein each supporting element comprises a supporting portion and a guiding portion, the guiding portion covered by a deck of the housing aside of the recess thereof when the supporting element is in its supporting position, lateral flanges are provided at both sides of the guiding portion, a plurality of crosswise guiding rails are fastened at the bottom surface of the deck, each guiding rail composed of a central body provided with lateral supporting ribs overlapping flanges of adjacent supporting elements from below, the central body received between said flanges, wherein the supporting portion is provided with lateral rectangular wings, having a sufficient width such that the wings of adjacent supporting elements at least almost abut one another, and wherein the wings of the supporting portion are downwardly offset with respect to the flanges of the guiding portion by an amount at least equal with the thickness of the supporting ribs, so that during displacement of the supporting elements the wings thereof will pass below the guiding trails.

10. A ski waxing machine as claimed in claim 1, wherein the plurality of supporting elements are mounted for a sliding movement by a plurality of guiding rails, which are arranged in a plane sloping outwardly and forming a small acute angle with a horizontal plane.

11. A ski waxing machine as claimed in claim 4, wherein each end track comprises an open-top groove and the follower is in the form of a downwardly extending pin for tracking in said groove, wherein the groove has a bottom, the pin of at least one of the plurality supporting elements resting on said bottom thereby lifting a supporting portion thereof in relation to an adjacent one of the plurality of supporting elements, engaged by the transfer track.

12. A ski waxing machine as claimed in claim 1, wherein a spring biased catch is provided for holding each one of the plurality of supporting elements in the supporting position.

13. A ski waxing machine as claimed in claim 1, wherein the rails for the slide, the driving motor and the driving arrangement are mounted on a lifting frame, which in a lowered position allows to return the slide longitudinally without engaging the plurality of supporting elements by the pair of transfer tracks.

14. A ski waxing machine as claimed in claim 1, wherein the housing comprises a deck plate in which a pair of oblong parallel recesses are provided, each one having a width adapted to receive one ski and wherein a pair of rows of supporting elements are provided each one for closing one of the pair of recesses, and wherein two pairs of laterally reversed transfer tracks are provided at the slide to slide two laterally aligned supporting elements of said pair of rows of supporting elements at a time in substantially opposite directions.

15. A ski waxing machine as claimed in claim 1, wherein the deck of the housing is provided with a pair of identical oblong parallel recesses, deck walls extend laterally from each one of the recesses respectively in opposite outward directions, the waxing means comprise at least one wax container, a wax roller immerging into the wax container and wherein at least one wax storage tank is arranged at the slide beneath one of the deck walls and means are provided to communicate the storage tank with the wax container.

* * * * *